United States Patent [19]

Bayer

[11] Patent Number: 4,747,010

[45] Date of Patent: May 24, 1988

[54] BI-STABLE ELECTROMAGNETIC DEVICE

[75] Inventor: Eric W. Bayer, North East, Pa.

[73] Assignee: General Electric Company, Erie, Pa.

[21] Appl. No.: 39,202

[22] Filed: Apr. 16, 1987

[51] Int. Cl.[4] ..... H01H 9/24; H01H 47/04

[52] U.S. Cl. ..... 361/210; 335/177; 335/181

[58] Field of Search ..... 335/177, 181, 182, 183, 335/236, 85, 89, 128, 129, 268, 269, 276; 361/147, 191, 210

[56] References Cited

U.S. PATENT DOCUMENTS

| | | | |
|---|---|---|---|
| 2,564,246 | 8/1951 | Bourne | 335/181 |
| 3,001,049 | 9/1961 | Didier | 335/181 |
| 3,621,419 | 11/1971 | Adams et al. | 335/230 |
| 3,693,122 | 9/1972 | Willard | 335/236 |
| 4,072,918 | 2/1978 | Read, Jr. | 335/236 |
| 4,286,244 | 8/1981 | Schuessler et al. | 335/230 |

*Primary Examiner*—L. T. Hix
*Assistant Examiner*—David Porterfield
*Attorney, Agent, or Firm*—A. S. Richardson, Jr.

[57] ABSTRACT

A bi-stable magnetically latched electromagnetic device has an E-shaped frame, a rocker-type armature spanning the distal ends of the two outer legs of the frame, with the mid-region of the armature being pivotally supported on the distal end of the center leg for reciprocal movement between alternative stable positions, and first and second electrically interconnected helical coils each encircling a magnetizable core in a different one of the two interleg spaces of the frame. First and second permanent magnets are disposed between the base of the frame and the first and second coils, respectively, and first and second magnetic flux diverters are interposed between the respectively associated coils and magnets. The coils are connected to relatively positive and negative control power terminals via selectively operative means for providing alternative first and second current paths. When the first path is effective, a strong magnetic field in the first coil aids the field of the first magnet and attracts the armature to a first of its two positions, while a weaker field in the second coil opposes the field of the second magnet, thereby causing the latter field to shift from the armature to the second diverter and, in the process, to release the armature for movement to its first position. To move the armature from the first position, the strong field is created in the second coil and the weak opposing field is created in the first coil.

7 Claims, 4 Drawing Sheets

BI-STABLE ELECTROMAGNETIC DEVICE

BACKGROUND OF THE INVENTION

This invention relates generally to electromagnetic devices having armatures that reciprocate between two stable, alternative positions, and it relates more particularly to a bi-stable electromagnetic device that is useful for actuating contacts of an electric current reverser.

While useful in a variety of electrical or mechanical applications, the invention will be herein disclosed in the context of a bi-stable or double-throw electric current reverser for the electrical propulsion system of a traction vehicle such as a rapid transit car. For this particular application, the electromagnetic device needs to be sufficiently rugged and reliable to withstand physical shock and vibration and temporary loss of control power without unlatching. That is, the contact-carrying armature of the bi-stable device must be held firmly in a preselected position and must not move to its other position when the mounting base of the device is subjected to physical forces of relatively high amplitude and/or when control power for the operating coils is interrupted.

One known approach to obtaining the required hold-down or latching function in a bi-stable electromagnetic device is to utilize an overcenter toggle mechanism. However, such mechanisms are undesirably large and expensive, are complicated to adjust, and tend to be less reliable than required for many applications.

Another known approach is to utilize permanent magnets for releasably latching the armature of an electromagnetic device in either of two stable positions. Prior art U.S. Pat. Nos. 3,001,049; 3,621,419; and 4,286,244 are exemplary.

SUMMARY OF THE INVENTION

A general objective of the present invention is to provide an improved bi-stable electromagnetic device having permanent magnet latching.

Another objective is to provide such a device that is relatively compact, durable, easy to maintain, and cost effective to manufacture.

A more specific objective of the invention is to provide an improved latching type bi-stable electromagnetic device that uses a relatively small amount of energy to release the latch on command and that changes rapidly from one stable position to another when unlatched.

In carrying out the invention in one form, a bi-stable electromagnetic device is provided with an E-shaped frame of magnetizable material having a pair of generally parallel outer legs on opposite sides of a center leg projecting from a common base. The distal ends of the outer legs of the frame are spanned by a rocker-type armature of magnetizable material. The distal end of the center leg centrally supports the armature for reciprocal, pivotal movement between a first position in which the distal end of a first one of the outer legs abuts the armature near one end thereof, and a second position in which the distal end of the other outer leg abuts the armature near the opposite end thereof.

Two separate magnetizable cores are mounted on the base of the frame in the interleg spaces of the device, and they are respectively encircled by first and second multi-turn operating coils. Between the base and the first and second coils, first and second permanent magnets are respectively disposed so that the magnetic flux of the first magnet is normally effective when the armature is in its first position, whereas the magnetic flux of the armature in that position, whereas the magnetic flux of the second magnet is normally effective when the armature is in its second position releasably to latch it in that position. First and second magnetic flux diverters are interposed between the respectively associated coils and permanent magnets, with each diverter extending beyond the magnet in opposite directions toward the center leg and the adjacent outer leg of the frame, respectively.

Means is provided for connecting both of the operating coils to relatively positive and negative control power terminals. The connecting means includes selectively operative means for providing alternative first and second paths in which direct current can flow from the positive terminal to the negative terminal and through the coils. The coils are so wound that when the first current path becomes effective, the resulting current in the first coil produces a strong magnetic field that aids the magnetic field associated with the first permanent magnet and attracts the armature to its first position while the magnetic field associated with the second permanent magnet is shifted from the armature to a path including the second diverter by an opposing magnetic field produced by current in the second coil. As the magnetic flux of the second magnet is diverted from the armature, its latching effect is neutralized or defeated and the armature can move quickly from its second position to the aforesaid first position.

Alternatively, when the second current path becomes effective, current in the second coil will produce a strong magnetic field aiding the field of the second magnet and attracting the armature to its second position, while the first magnetic field is shifted from the armature to a path including the first diverter by an opposing field produced by current in the first coil. As the magnetic flux of the first magnet is diverted from the armature, the armature is again unlatched and can quickly reverse positions. This latch-releasing process requires only a relatively small amount of electric energy. The opposing magnetic fields have less than one-third the strength of the aforesaid aiding fields.

In one aspect of the invention, the aforesaid first current path comprises the first coil connected in parallel with the series combination of the second coil and a resistor, and the aforesaid second current path comprises the second coil connected in parallel with the series combination of the first coil and a resistor. In another aspect, the first current path comprises the first coil connected in series with only a portion of the second coil, whereas the second current path comprises the second coil connected in series with only a portion of the first coil.

The invention will be better understood and its various objects and advantages will be more fully appreciated from the following description taken in conjunction with the accompanying drawings.

DETAILED DESCRIPTION

Figure 1:
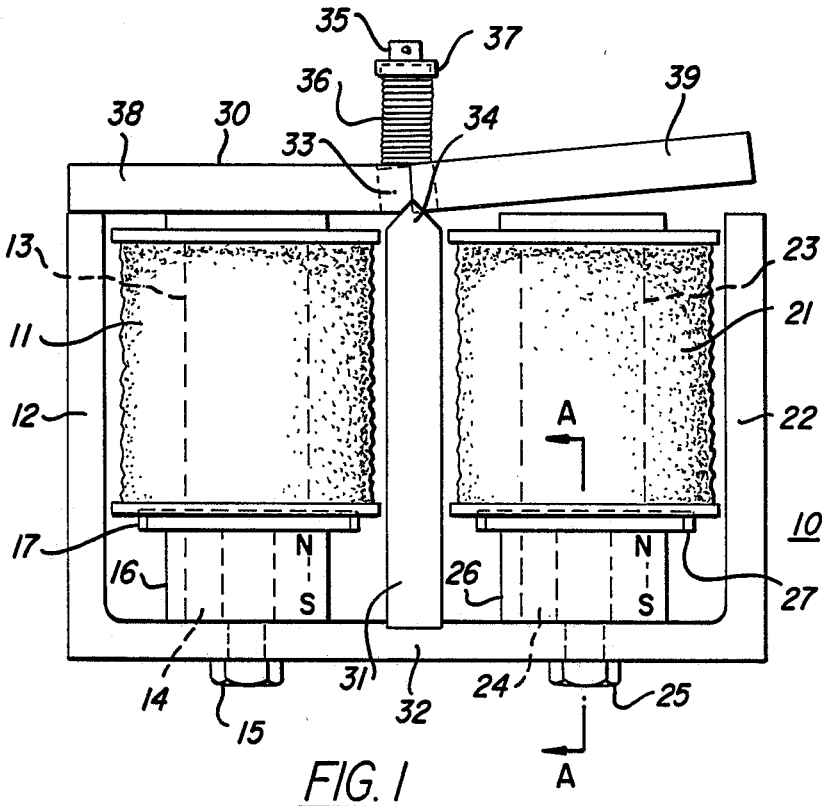
FIG. 1 is a side elevation of a simplified version of a bi-stable electromagnetic device that embodies the present invention.

The bi-stable electromagnetic device that is illustrated in FIG. 1 comprises an E-shaped frame 10 (commonly called a dual U frame) of magnetizable material, first and second duplicate, multi-turn helical coils 11 and 21, respectively, and a rocker-type armature 30. The frame 10 has a pair of generally parallel outer legs 12 and 22 on opposite sides of a center leg 31 projecting from a common base 32. Preferably the outer legs 12 and 22 and the base 32 of the frame 10 are formed from one piece of metal, and the center leg 31 is a separate piece whose proximal end is affixed to the base 32 by means of holts (not shown in FIG. 1) or the like.

The armature 30, also made of magnetizable material, spans the distal ends of the outer legs 12 and 22 of the frame 10. As can be seen in FIG. 1, the two ends of the armature 30 form an obtuse angle, and their juncture at the center or mid-region 33 of the armature is pivotally supported on the distal end 34 of the center leg 31. Preferably the distal end 34 has a tapered profile as shown, thereby forming a knife-edge hinge with the armature 30. A rod 35 projecting upwardly from the center leg 31 passes freely through a hole in the middle of the armature 30 and is enricled by a holddown spring 36 compressed between the top of the armature's mid-region 33 and a spring seat 37 that is releasably attached to the upper end of the rod 35. It will be apparent that the armature 30 can rock or move reciprocally on the knife edge 34 between a first position (shown in FIG. 1) in which the distal end of the first outer leg 12 abuts the armature near one end 38, and a second position in which the distal end of the second outer leg 22 abuts the armature near its opposite end 39.

Figure 1A:
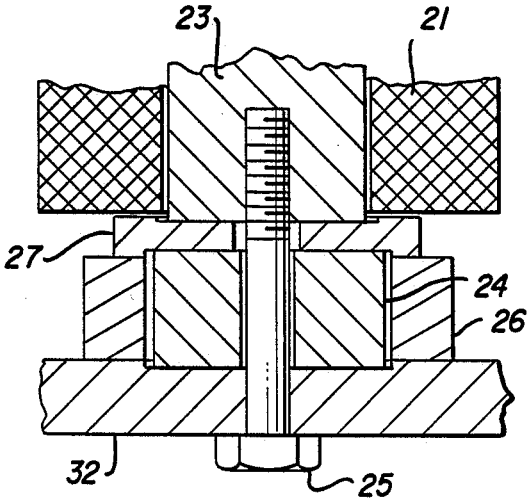
FIG. 1A is an enlarged sectional view of the electromagnetic device taken through lines A—A of FIG. 1.

In the interleg spaces of the frame 10 of the illustrated device, there are two cylindrical cores 13 and 23 of magnetizable material that are mounted on the base 32, and the two multi-turn coils 11 and 21 respectively encircle these cores. First and second duplicate permanent magnets 14 and 24 are disposed between the base 32 and the coils 11 and 21, respectively. Each of the magnets 14 and 24 has the shape of a ring or hollow cylinder, and it is made of Alnico or other suitable material which, once magnetized, has a relatively strong and permanent magnetic field oriented in the axial direction. These magnets are tightly sandwiched between the base 32 and the cores 13, 23 of the respectively associated coils 11, 21 by means of stainless steel bolts 15 and 25, respectively. Preferably, as is indicated in FIG. 1A, the magnets 14, 24 are shielded, respectively, by tubular members 16 and 26 of non-magnetic material such as copper.

When the armature 30 is in its first position, a relatively low reluctance path (including the core 13, the left end 38 of the armature 30, and the first outer leg 12 of the frame 10) is provided for the magnetic flux of the first permanent magnet 14, and the field of this magnet is normally effective releasably to latch the armature in that position. On the other hand, when the armature 30 is in its second position, a relatively low reluctance path (including the core 23, the right end 39 of the armature, and the second outer leg 22 of the frame) is provided for the magnetic flux of the second permanent magnet 24, and the field of the second magnet is normally effective releasably to latch the armature in the second position.

In accordance with the present invention, the electromagnetic device also has first and second magnetic flux diverters 17 and 27 (also called magnetic shunts) interposed between the respectively associated coils 11, 21 and permanent magnets 14, 24. Each such diverter is a relatively thin, flat piece of magnetizable material. As is best seen in FIG. 1A, it is traversed by the bolt (15 or 25) and is captured between the upper end of the associated magnet (14 or 24) and the overlying core (13 or 23), with both the magnet and the core resting in shallow concentric recesses that are provided in opposite surfaces of the diverter for this purpose. Each diverter has an oblong shape and extends beyond the associated magnet in opposite directions toward the center leg 31 and toward the adjacent outer leg (12 or 22) of the frame 10. Preferably the outermost ends of the each diverter are convex in shape (in the horizontal plane), and the apex of each of these ends is separated from the inboard surface of the closest leg by a relatively short (e.g., approximately one-half inch) air gap.

As long as the armature 30 is in its first position and the first coil 11 either is de-energized or is energized by current that produces a magnetic field having a polarity in agreement with the field of the first permanent magnet 14, no appreciable portion of the latter field is diverted or shunted from the core 13 and armature 30 by the diverter 17. But if the direction of current in the coil 11 were reversed, the resulting field of this coil will oppose the field of the first magnet 14 and cause it to shift from the core 13 and armature 30 to a path including the diverter 17 and the short air gaps at its opposite ends.

In accordance with the present invention and in a manner that will be more fully described hereinafter, the two operating coils 11 and 21 of the electromagnetic device are connected to a source of direct current via selectively operative means that provides alternative first and second paths in which current can flow through these coils. The coils are so wound that when the first current path is effective, the resulting current in the first coil 11 produces a very strong magnetic field that aids or boosts the magnetic field associated with the first permanent magnet 14 and attracts the armature 30 to its first position, while the magnetic field associated with the second permanent magnet 24 is shifted from the armature to a path including the second diverter 27 by an opposing or bucking magnetic field produced by current in the second coil 21. Alternatively, when the second current path is effective, the current in the second coil 21 produces a very strong magnetic field aiding the magnetic field of the second magnet 24 and attracting the armature 30 to its second position, while the magnetic field of the first magnet 14 is shifted from the armature to a path including the first diverter 17 by an opposing magnetic field produced by current in the first coil 11. Each of the aforesaid opposing magnetic fields is comparable in strength to the permanent magnet field but is appreciably weaker than (i.e., less than one-third the strength of) each of the aforesaid aiding fields. Whenever current changes from the first path to the second path (or vice versa), the following changes take place in the left end 38 (or in the right end 39) of the armature 30: the latching field of the magnet 14 (or 24) decays to zero due to the above-described flux-diverting process; and the opposing field produced by current in the coil 11 (or 21) builds up in the opposite direction. Consequently, there is a brief moment of time when the field in this end of the armature is null or negligible and the magnetic latching force is released. Concurrently, the other end of the armature is being attracted by a strong magnetic field, and the armature quickly rocks or pivots to its second (or first) position.

Figure 3:
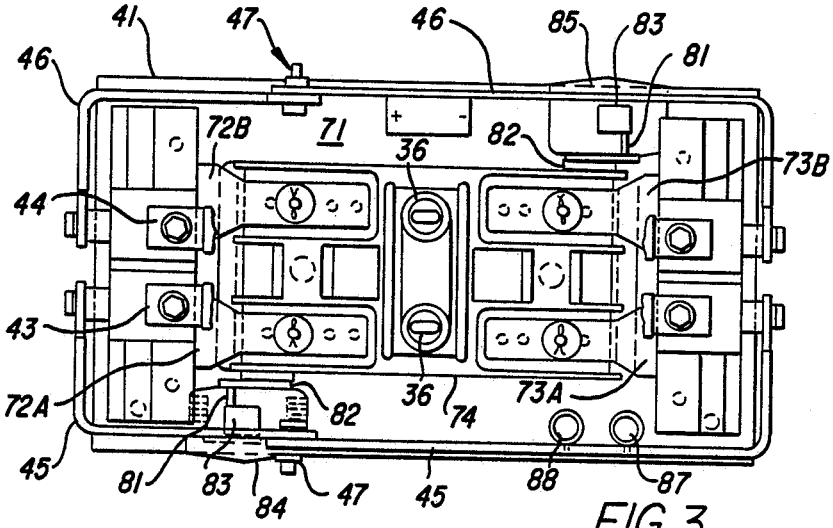
FIG. 3 is a plan view of the reverser through section 3—3 of FIG. 2.
Figure 2:
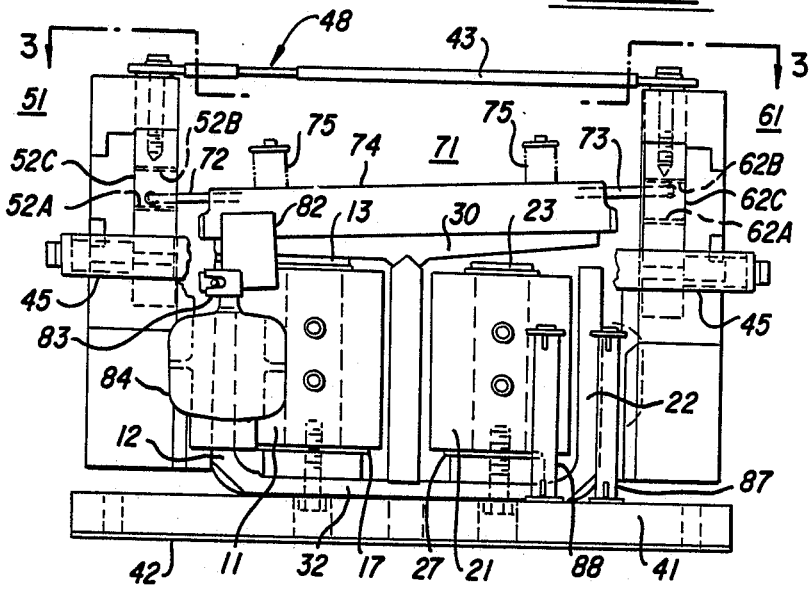
FIG. 2 is a side elevation of an electric current reverser the movable contacts of which are actuated by the device shown in FIG. 1.
Figure 4:
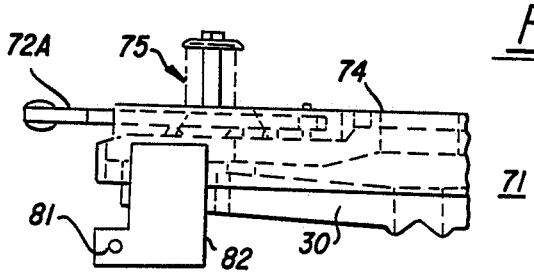
FIG. 4 is an elarged side elevation of one set of the reverser's movable bridging-type contacts that are carried on the rocker-type armature of the FIG. 1 device.

A practical embodiment of the FIG. 1 device is shown in FIGS. 2–4 where an electric current reverser having four sets of movable bridging-type contacts is illustrated. For the sake of clarity and convenience, in FIG. 2 any parts that correspond to those described above have been given the same reference numbers as in FIG. 1. As is best-shown in FIG. 2, the reverser has a mounting base 41 of suitable insulating material to which the base 32 of the magnetizable E-shaped frame of the bi-stable electromagnetic device is bolted or otherwise attached. Fastened to the bottom of the base 41 is a thin insulating shield 42. First and second duplicate stationary contact assemblies 51 and 61 are respectively supported on the two outer legs 12 and 22 of the frame.

Each of the stationary contact assemblies 51 and 61 of the illustrated reverser comprises a molded member of insulating material to which a plurality of electroconductive contacts are anchored. The first assembly 51 has two sets 52 and 53 of contacts, each set in turn comprising two pairs A-a and B-b of cooperating, horizontally spaced apart individual members, with the B-b pair being located in vertically spaced relation above the A-a pair. The second stationary contact assembly 61 also has two sets 62 and 63 of similarly paired contact members. FIG. 2 reveals (in phantom lines) the outboard members 52A and 52B of the stationary contact set 52 and the outboard members 62A and 62B of the stationary contact set 62. In practice, both of the members 52A and 52B are located on and interconnected by a single channel-shaped piece 52C of copper or the like, and the members 62A and 62B are similarly located on and interconnected by a channel-shaped conductor 62C. The other 12 stationary contact members cannot be seen in FIGS. 2 and 3, but they are shown schematically in FIG. 5 which will soon be described.

The two assemblies 51 and 61 are interconnected by four insulated copper bus bars 43, 44, 45, and 46, with bar 43 connecting the upper inboard member **52*b* of stationary contact set 52 to the upper inboard member 62*b* of the opposite stationary contact set 62, with bar 44 similarly connecting the upper inboard member 53*b* of stationary contact set 53 to the corresponding member 63*b* of the opposite set 63, with bar 45 connecting the lower inboard member 52*a* of the set 52 to the lower inboard member 62*a* of the set 62, and with bar 46 similarly connecting the lower inboard member 53*a* of the set 53 to the opposite member 63*a*. As is indicated in FIGS. 2 and 3, the two bus bars 43 and 44 extend parallel to one another along the top of the reverser, and the other two bus bars 45 and 46 extend along the respective sides of the reverser. Each of the latter two bars is actually formed by two conductors that are joined together by a bolt 47. Electric cables from a pair of external load circuits (not shown) can be conveniently connected to the resulting joints of the bus bars 45 and 46, respectively, and cables can also be connected to uninsulated areas 48 of the bus bars 43 and 44**.

As is best seen in FIGS. 3 and 4, the reverser includes a movable contact assembly 71 that is disposed on the armature 30 of the bi-stable electromagnetic device. The assembly 71 comprises a support 74 of molded insulating material firmly attached to the armature 30, and two sets 72 and 73 of movable bridging contacts respectively located at the opposite ends of this support. Each of the contact sets 72 and 73 comprises a pair of horizontally spaced apart T-bars A and B made of electroconductive material, with suitable contact surfaces being respectively formed on both the top and bottom sides of the board end of each T-bar. The stem of each T-bar contact is resiliently mounted on the movable contact support 74, and each T-bar is so aligned and arranged that its bottom contact surface will span or bridge an A-a pair of stationary contact contact members when the armature is in one of its two stable positions, whereas the bottom contact surface will part from the A-a members and the top contact surface will make bridging contact with the overlying B-b pair of stationary contact members when the armature is moved to its alternative position. As is shown in FIGS. 3 and 4, each of the T-bar contacts 72A, 72B, 73A and 73B is attached to the support 74 by means of a ball pivot, spring loaded arrangement that ensures the proper alignment and the desired wiping action of these contacts. The individual biasing springs are designated by the reference number 75.

There is a laterally projecting pin 81 near each end of the movable contact assembly 71, the pin 81 protruding from a plate 82 attached to the side of the contact support 74. Each pin 81 cooperates with a bifurcated actuating arm 83 of a separate "interlock" or position sensor. In FIGS. 2 and 3 the near-side position sensor is designated by the reference number 84 and the far-side position sensor is designated by the reference number 85. Each position sensor contains an auxiliary contact (or an equivalent solid-state circuit) that is switched between a first state (F) and a second state (R) upon movement of its actuating arm 83 in response to an armature position change of the bi-stable electromagnetic device. The manner in which the position sensor contacts are interconnected and utilized in the operation of the reverser is shown schematically in FIGS. 5 and 6 which will soon be described.

The mounting base 41 of the reverser includes provisions for mounting two duplicate voltage dropping resistors if required. In FIGS. 2 and 3 such resistors are shown at 87 and 88. In one embodiment of the invention, the reverser's stationary contact sets 52, 53, 62, and 63 are connected to an external electrical power circuit and its operating coils 11 and 21 are connected to a direct current (d-c) source in the manner illustrated in FIG. 5.

Figure 5:
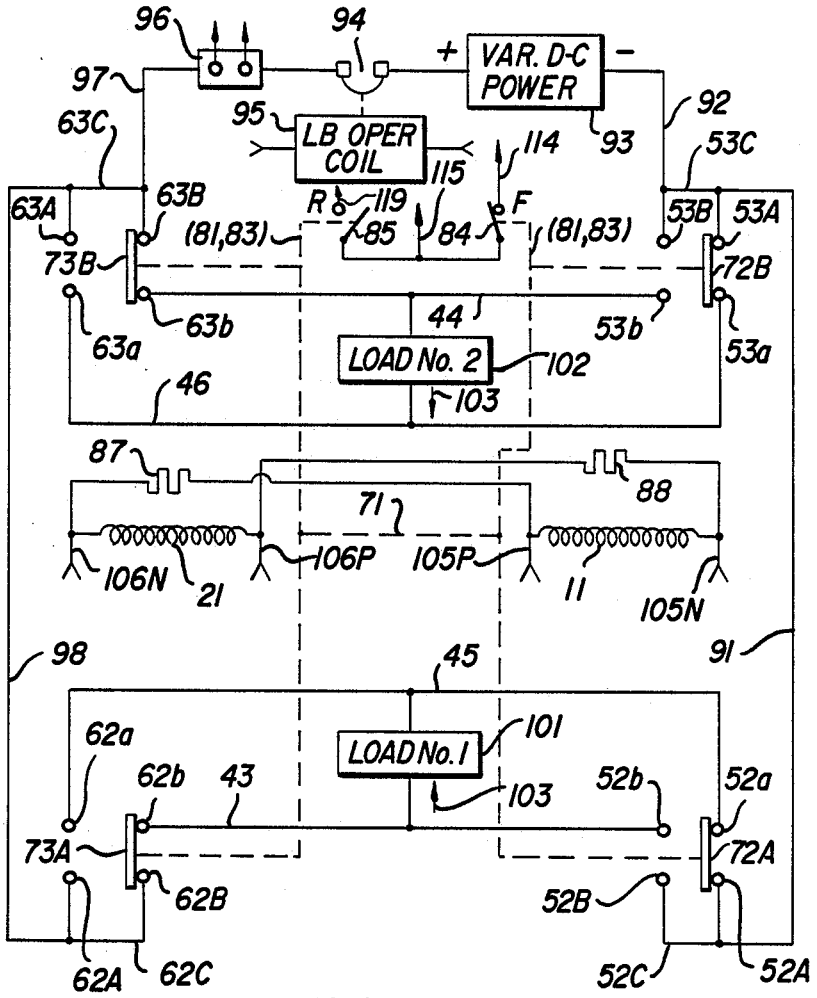
FIG. 5 is a schematic diagram of the two operating coils of the FIG. 1 device and of the electric power circuit to which the reverser's stationary contacts are connected.

FIG. 5 shows the reverser with its movable contact assembly 71 in a "forward" position which corresponds to the previously described first position of the electromagnetic device (see FIG. 1). In this position the T-bar contact 72A bridges the lower stationary contact members 52A and **52*a* and the companion T-bar 72B bridges the lower contact members 53A and 53*a*, whereas the T-bar 73A bridges the upper stationary contact members 62B and 62*b* and the T-bar 73B bridges the other upper contact members 63B and 63*b*. Both of the stationary contact members 52A and 53A are connected via current conductors 91 and 92 to a relatively negative terminal of a suitable source 93 of variable d-c electric power (e.g., the power derived from a wayside substation by the current collector of a rapid transit car). The positive terminal of the source 93 is connected via the separable contacts of a line breaker 94 (whose operating mechanism 95 is labeled "LB OPER COIL"), a current sensor 96, and wires 97 and 98 to the stationary contact members 62B and 63B. A first load circuit 101 is connected between the two bus bars 43 and 45, and a second load circuit 102 is connected between the two bus bars 44 and 46. (The load circuits are typically the armature or field windings of a pair of d-c traction motors, and their continuous current ratings are typically on the order of 450 amperes.) It will now be apparent that in the illustrated position of the reverser, the output current of the power source 93 can flow through the two load circuits in the direction of the pointers 103. It will also be apparent that if the movable contact assembly 71 were moved to its other or "reverse" position, the previously open stationary contact members 52B-b, 53B-b, 62A-a, and 63A-a would be bridged by the T-bar contacts 72A, 72B, 73A, and 73B, respectively, and current from the source 93 would flow through the load circuits in a direction opposite to the pointers 103**.

The position of the reverser and hence the direction of current in the load circuits is actually determined by selectively operative means in a control circuit to which the two operating coils 11 and 21 are connected, via lines 105P, 105N, 106P, and 106N. As can be seen in FIG. 5, the coil 11 is connected across lines 105P and 105N, and the coil 21 is connected across lines 106P and 106N. In addition, the two coils are cross-connected via the resistors 87 and 88, with resistor 87 being connected between lines 105P and 106N and the resistor 88 being connected between lines 106P and 105N. A representative control circuit for a reverser on a rapid transit car is shown schematically in FIG. 6 which will now be described.

Figure 6:
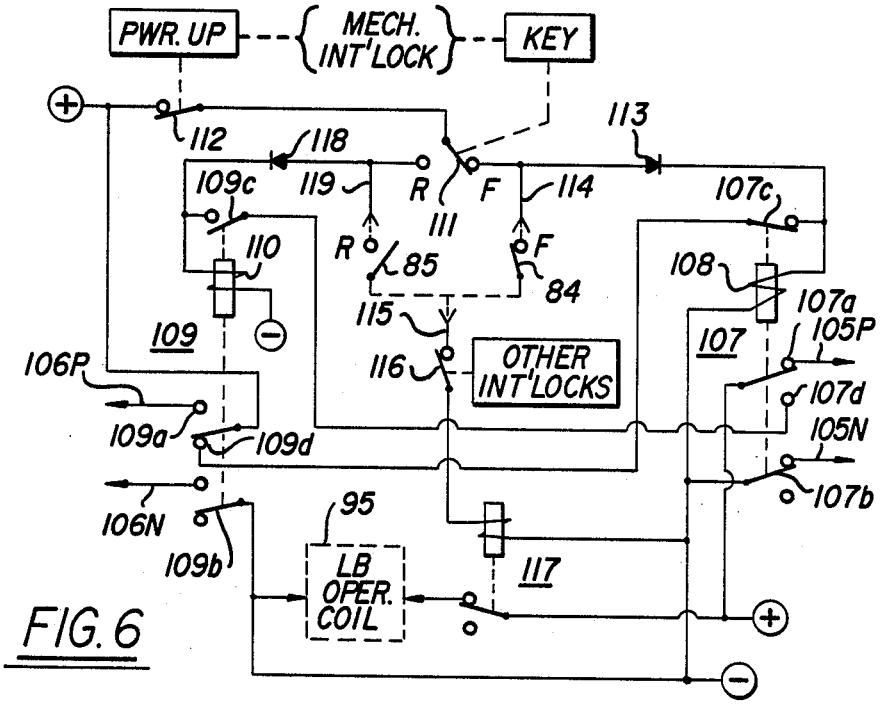
FIG. 6 is a schematic diagram of the control circuit and relays associated with the operating coils shown in FIG. 5.

In FIG. 6 the encircled plus and minus symbols (+ and −) represent relatively positive and negative terminals, respectively, of a d-c control power source, such as a vehicle battery and/or a battery charger (not shown). Normally the voltage magnitude of this source will be approximately 37 volts, but in some abnormal circumstances it can drop temporarily to a much lower magnitude or zero. The first operating coil 11 of the reverser (FIG. 5) is connected to the positive and negative control power terminals via a first path comprising the lines 105P and 105N and a pair of normally open contacts **107*a* and 107*b* of a first auxilliary relay 107 whose operating coil 108 is shown energized ("picked up") in FIG. 6. In this condition the contacts 107*a* and 107*b* are closed and full control power voltage is applied across the coil 11 with correct polarity (i.e., line 105P is positive with respect to line 105N). This coil is wound so that the resulting current produces a strong magnetic field aiding the magnetic field of the associated permanent magnet 14 (FIG. 1) and holding the movable contact assembly 71 of the reverser in its "forward" position. In a manner previously explained, the permanent magnet 14 latches the movable contact assembly in this position in the abnormal event of a temporary loss of control power. At the same time, due to the voltage dropping resistors 87 and 88 (FIG. 5), a reduced voltage is applied across the parallel operating coil 21 of the reverser with inverted polarity (i.e., line 106P is negative with respect to line 106N). The second coil 21 is wound so that its current now produces a relatively weak magnetic field of comparable strength but opposite sense to the field of the second permanent magnet 24. In practice each of the resistors 87 and 88 should have sufficient resistance to reduce the voltage on coil 21 to less than approximately one-third the voltage on coil 11**.

The second operating coil 21 of the reverser (FIG. 5) is connected to the positive and negative control power terminals via a second path comprising the lines 106P and 106N and a pair of normally open contacts **109*a* and 109*b* of a second auxiliary relay 109 whose operating coil 110 is shown de-energized ("dropped out") in FIG. 6. Although the auxiliary relays 107 and 109** are illustrated as conventional moving-contact devices, their functions could alternatively be performed by well known solid-state switching means.

The energized versus de-energized state of the auxiliary relays 107 and 109 is determined by a manually operated reversing switch 111 having alternative F (forward) and R (reverse) positions. The common terminal of the switch 111 is connected to the positive control power terminal via a "power up" contact 112 that is closed only when the main handle of a master controller (not shown) is in a position calling for traction power on the transit car. In a conventional manner, the master controller is mechanically interlocked with the operating key of the reversing switch 111 so that the latter switch cannot be moved from F to R positions (or vice versa) except when the main handle is in either a "coast" or a "brake" position, and so that the main handle cannot be moved out of its coast or brake position except when the switch 111 is in either its F or R position.

The F terminal of the reversing switch 111 is connected to the negative control power terminal through an isolating diode 113 and the operating coil 108 of the first auxiliary relay 107, whereby the relay 107 is picked up and its contacts **107*a* and 107*b* are closed so long as the forward position of the switch 111 is selected and the power up contact 112 is closed. If a seal-in circuit for the relay coil 108 were desired, the positive control power terminal could be connected to this coil by means of an alternative path comprising a normally open contact 107*c* of the relay 107 in series with a normally closed contact 109*d* of the second auxiliary relay 109**.

The F terminal of the reversing switch 111 is also connected to the negative control power terminal through a line 114, the F contact of the position sensor 84 (FIG. 5), a line 115, a contact 116, and the operating coil of a third auxiliary relay 117. The contact 84F is closed so long as the movable contact assembly 71 of the reverser is in its forward position. The closed state of the contact 116 depends in turn on the states of a number of other interlocks not relevant to the present invention. In FIG. 6 the operating coil of the third auxiliary relay 117 is shown energized. In this picked up state the relay contact is closed, thereby connecting the operating mechanism 95 of the line breaker 94 (FIG. 5) across the control power terminals. As a result, the line breaker is closed. But if the master controller were moved to a coast or brake position, the power up contact 112 would be open, the third auxiliary relay 117 would consequently drop out, the mechanism 95 would be de-energized, and the separable contacts of the line breaker 94 would then be open.

The R terminal of the reversing switch 111 is connected to the negative control power terminal through an isolating diode 118 and the operating coil 110 of the second auxiliary relay 109, whereby the relay 109 would be picked up and its contacts 109*a* and 109*b* would be closed if the reverse position of the switch 111 were selected and the power up contact 112 were closed. An optional seal-in circuit for the relay coil 110 is shown in FIG. 6, comprising the normally open contact 109*c* of the relay 109 in series with a normally closed contact 107*d* of the first auxiliary relay 107.

The R terminal of the reversing switch 111 is also connected to the line 115 through a line 119 and the R contact of the position sensor 85 (FIG. 5). The contact 85R does not close until the movable contact assembly 71 of the reverser has moved to its reverse position.

For a better understanding of the FIG. 6 embodiment of the reverser control circuit, a typical forward-to-reverse operation will now be briefly described. Before moving the reversing switch 111 from position F to position R, the master controller must be moved to a coast or brake position. This step causes the controllable electric power source 93 (FIG. 5) to reduce the magnitude of its output current to zero and causes the power up contact 112 to open. Consequently the third auxiliary relay 117 drops out and causes the line breaker 94 to open its contacts, thereby disconnecting the reverser from the source 93. Upon moving the reversing switch 111 to position R, the operating coil 110 of the second auxiliary relay 109 is energized and the relay 109 picks up, thereby closing the contacts 109*a, b,* and *c.* Concurrently, the contact 109*d* will open the seal-in circuit (if provided) for the operating coil 108 of the first auxiliary relay 107 which then drops out. (For a short interval of approximately 50 milliseconds both relays 107 and 109 may be picked up.)

When the contacts 107*a* and 107*b* of the relay 107 open, the first current path (lines 105P, 105N) for the reverser operating coils is opened, and when the contact 107*d* closes, the second auxiliary relay 109 is sealed in. At the same time, the second current path (including the lines 106P and 106N and the closed contacts 109*a* and 109*b*)becomes effective. In this condition full control power is applied across the second operating coil 21 with correct polarity. This coil is wound so that the resulting current produces a strong magnetic field aiding the magnetic field of the associated permanent magnet 24 (FIG. 1) and tending to attract the movable contact assembly 71 of the reverser from its forward position to its reverse position. Due to the voltage dropping resistors 87 and 88 (FIG. 5) a reduced voltage is now applied across the parallel operating coil 11 with inverted polarity, and this coil produces a relatively weak magnetic field of comparable strength but opposite sense to the field associated with the permanent magnet 14. Consequently the magnetic flux of the first magnet 14 is rapidly shifted from the armature 30 to a path including the first diverter 17 (FIGS. 1 and 2). As the flux is being so diverted, the attractive force between the first core 13 and the adjacent end 38 of the armature 30 is reduced and becomes weaker than the strong attractive force being exerted at the opposite end 39 of the armature, thereby unlatching the movable contact assembly and permitting its rapid movement from forward to reverse positions. In the process, the position sensor 84 opens its contact F and the companion position sensor 85 then closes its contact R. As soon as contact 85R is closed (indicating that the reverser is latched in its reverse position) and the power up contact 112 is reclosed (indicating that the master controller is calling for traction power), the third auxiliary relay 117 picks up to cause the line breaker 94 to reclose, and current can resume flowing in the load circuits 101 and 102 but in the reverse direction (opposite to the pointers 103).

The reverse-to-forward operation of the reverser is generally similar to the forward-to-reverse operation described above. In either direction, the reversing action takes less than one second.

Figure 5A:
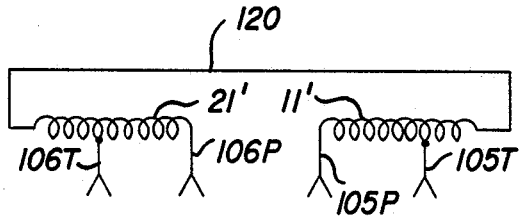
FIGS. 5A and 6A are schematic circuit diagrams of a second embodiment of the devices operating coils and of their associated control circuit, respectively.
Figure 6A:
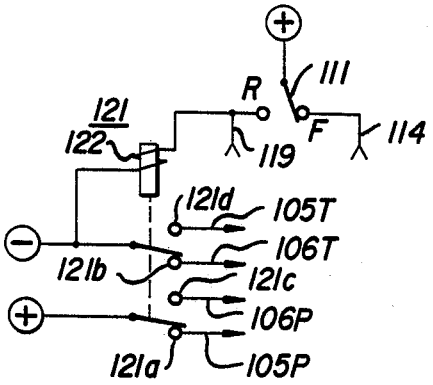

In another embodiment of the invention, illustrated schematically in FIGS. 5A and 6A, the voltage dropping resistors 87 and 88 are omitted, and each of the two operating coils of the electromagnetic device is provided with a tapped turn between its opposite ends. More particularly, as is indicated in FIG. 5A, the first end of the first operating coil 11' of this embodiment is connected to the line 105P, the first end of the second operating coil 21' is connected to the line 106P, and the second ends of the respective coils are directly interconnected by means of a line 120. A tapped turn between opposite ends of the coil 11' is connected to a line 105T, and a correspondingly tapped turn between opposite ends of the coil 21' is connected to a line 106T. These intermediate taps are located so that the portion of the coil between the line 105T (or 106T) and the line 120 is a predetermined, relatively small percentage (e.g., in a range of approximately 20% to 30%) of the total turns of the coil. Preferably, in a 4,000-turn coil the tapped portion has 1,000 turns.

The coils 11' and 21' are connected via alternative first and second paths to a direct current source in an associatied control circuit. With reference to FIG. 6A, the first path comprises the lines 105P and 106T and a pair of normally closed contacts 121*a* and 121*b* of an auxiliary relay 121 whose operating coil 122 is shown de-energized (dropped out). When this path is effective, current can flow from the positive to the negative control power terminals through the closed contact 121*a,* the line 105P, all of the turns of the first coil 11' in a P to N direction but only the tapped portion of the second coil 21' in an N to P direction, the line 106T, and the closed contact 121*b.* The coils 11' and 21' are wound so that current in the first path provides in the first coil maximum magnetomotive force that produces a strong magnetic field aiding the magnetic field of the associated permanent magnet 14 (FIG. 1) and attracting the movable contact assembly 71 of the reverser to its forward position, while the same current in the serially connected tapped portion of the second coil provides an appreciably reduced magnetomotive force that produces a relatively weak magnetic field of comparable strength but opposite sense to the field of the second permanent magnet 24.

The second path in FIGS. 5A and 6A comprises the lines 106P and 105T and a pair of normally open contacts 121*c* and 121*d* of the auxiliary relay 121. When this relay is energized (picked up) and the second path is consequently effective, current can flow from the positive to the negative control power terminals through the closed contact 121*c,* the line 106P, all the turns of the second coil 21' in a P to N direction but only the tapped portion of the first coil 11' in an N to P direction, the line 105T, and the closed contact **121*d*. Current in the second path provides in the second coil maximum magnetomotive force that produces a strong magnetic field aiding the field of the second permanent magnet 24 (FIG. 1) and attracting the movable contact assembly 71 of the reverser to its reverse position, while the same current in the serially connected tapped portion of the first coil provides an appreciably reduced magnetomotive force that produces a relatively weak magnetic field of comparable strength but opposite sense to the field of the first magnet 14**.

The energized versus de-energized state of the auxiliary relay 121 is determined by the manually operated reversing switch 111. The common terminal of the switch 111 is connected to the positive control power terminal as before, and its R terminal is connected to the negative control power terminal through the operating coil 122 of the auxiliary relay 121. Consequently the auxiliary relay 121 is picked up when the switch 111 is in its reverse position and is otherwise dropped out. Although the auxiliary relay 121 is illustrated as a conventional moving-contact device, its function could alternatively be performed by known solid-state switching means.

While two embodiments of the invention have been shown and described by way of example, other modifications will undoubtedly occur to persons skilled in the art. The concluding claims are therefore intended to cover all such modifications as fall within the true spirit and scope of the invention.

I claim:

1. A bi-stable electromagnetic device comprising:

(a) an E-shaped frame of magnetizable material having first and second generally parallel outer legs and a center leg projecting from a common base;

(b) a rocker-type armature of magnetizable material spanning the distal ends of said outer legs and having a mid-region pivotally supported on the distal end of said center leg for reciprocal movement between a first position in which the distal end of said first outer leg abuts the armature near one end thereof, and a second position in which the distal end of said second outer leg abuts the armature near the opposite end thereof;

(c) a pair of magnetizable cores mounted on said base in the interleg spaces of said frame;

(d) first and second multi-turn helical coils respectively encircling said pair of cores;

(e) first and second permanent magnets disposed between the base of said frame and said first and second coils, respectively, the magnetic field of said first magnet being normally effective when said armature is in its first position releasably to latch said armature in that position and the magnetic field of said second magnet being normally effective when said armature is in its second position releasably to latch it in that position;

(f) first and second magnetic flux diverters interposed between the respectively associated coils and permanent magnets, each diverter extending beyond the magnet in opposite directions toward said center leg and toward the adjacent outer leg of said frame, respectively; and (g) means for connecting said coils to a direct current source having relatively positive and negative control power terminals, said connecting means including selectively operative means for providing alternative first and second paths in which direct current can flow from said source through said coils;

(h) said coils being wound so that when said first current path is effective the resulting current in said first coil produces a strong magnetic field that aids the magnetic field associated with said first permanent magnet and attracts said armature to its first position while the magnetic field associated with said first permanent magnet is shifted from said armature to a path including said second diverter by an opposing magnetic field produced by current in said second coil, whereas when said second current path is effective the current in said second coil produces a strong magnetic field that aids the magnetic field of said second magnet and attracts said armature to its second position while the magnetic field of said first magnet is shifted from said armature to a path including said first diverter by an opposing magnetic field produced by current in said first coil, the strength of said opposing magnetic fields being a predetermined fraction of that of said strong fields.

2. The device of claim 1, in which said first current path comprises said first coil connected in series with only a portion of said second coil, and said second current path comprises said second coil connected in series with only a portion of said first coil.

3. The device of claim 2, in which said connecting means comprises means for directly connecting a predetermined end of said first coil to the corresponding end of said second coil, said first current path includes a connection between a predetermined one of said control power terminals and the other end of said first coil and a connection between the other control power terminal and a tapped turn between opposite ends of said second coil, and said second current path includes a connection between said one terminal and the other end of said second coil and a connection between said other terminal and a tapped turn between opposite ends of said first coil.

4. The device of claim 2, in which said predetermined fraction is less than approximately one-third.

5. The device of claim 1, in which said connecting means includes at least one voltage dropping resistor, said first current path comprises said first coil connected in parallel with the series combination of said second coil and said resistor, and said second current path comprises said second coil connected in parallel with the series combination of said first coil and said resistor.

6. The device of claim 5, in which each of said coils has first and second ends, said resistor is connected between the first end of said first coil and the second end of said second coil, said connecting means comprises means for interconnecting the first end of said second coil and the second end of said first coil, said first current path includes a connection between a predetermined one of said control power terminals and the first end of said first coil and a connection between the other control power terminal and the second end of said first coil, and said second current path includes a connection between said one terminal and the first end of said second coil and a connection between said other terminal and the second end of said second coil.

7. The device of claim 5, in which said predetermined fraction is less than approximately one-third.

* * * * *

UNITED STATES PATENT AND TRADEMARK OFFICE

CERTIFICATE OF CORRECTION

PATENT NO. : 4,747,010

DATED : May 24, 1988

INVENTOR(S) : E. W. Bayer

It is certified that error appears in the above-identified patent and that said Letters Patent is hereby corrected as shown below:

Column 2, line 2, cancel ", whereas the magnetic flux of" and substitute--releasably to latch--

Column 12, line 10, change "first" to--second--

Signed and Sealed this

Eighteenth Day of October, 1988

*Attest:*

DONALD J. QUIGG

*Attesting Officer*

*Commissioner of Patents and Trademarks*